US012030698B2

(12) United States Patent
Manderfield, Jr. et al.

(10) Patent No.: US 12,030,698 B2
(45) **Date of Patent: *Jul. 9, 2024**

(54) BOXED CONTAINER SYSTEM

(71) Applicant: Altium Packaging LP, Atlanta, GA (US)

(72) Inventors: Grover John Manderfield, Jr., Marietta, GA (US); Joey Arlin Palmer, Atlanta, GA (US)

(73) Assignee: Altium Packaging LP, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/473,451

(22) Filed: Sep. 13, 2021

(65) Prior Publication Data

US 2021/0403208 A1 Dec. 30, 2021

Related U.S. Application Data

(63) Continuation of application No. 17/179,621, filed on Feb. 19, 2021, now Pat. No. 11,117,721.
(Continued)

(51) Int. Cl.
*B65D 47/32* (2006.01)
*B65D 25/28* (2006.01)
(Continued)

(52) U.S. Cl.
CPC ..... *B65D 47/32* (2013.01); *B65D 25/2894* (2013.01); *B65D 47/06* (2013.01); *B65D 77/0426* (2013.01); *B65D 2547/066* (2013.01)

(58) Field of Classification Search
CPC ..... B65D 23/10; B65D 5/46; B65D 5/001; B65D 19/02; B65D 9/06; B65D 1/22;
(Continued)

(56) References Cited

U.S. PATENT DOCUMENTS 1,627,651 A 5/1927 Kautzsch
D145,758 S 10/1946 Snyder
(Continued)

FOREIGN PATENT DOCUMENTS

CA 2664553 A1 4/2008
CA 2848379 A1 3/2013
(Continued)

OTHER PUBLICATIONS

International Search Report, dated Jun. 8, 2021, from corresponding International Application No. PCT/US2021/018673.
(Continued)

*Primary Examiner* — Kareen K Thomas
(74) *Attorney, Agent, or Firm* — Thomas Horstemeyer, LLP

(57) ABSTRACT

A container system includes a container for holding a fluid. The container may be positioned within a box that provides structural support to the container while allowing the container system to be stacked. The container may include chamfered corners and a glug mitigation mechanism. The box may include corresponding chamfered corners and one or more access apertures for providing access to the container handle and container opening that are positioned within and below the top surface of the box.

32 Claims, 11 Drawing Sheets

Related U.S. Application Data

(60) Provisional application No. 62/979,877, filed on Feb. 21, 2020.

(51) Int. Cl.
*B65D 47/06* (2006.01)
*B65D 77/04* (2006.01)

(58) Field of Classification Search
CPC .... B65D 47/32; B65D 25/2894; B65D 47/06; B65D 77/0426; B65D 2547/066; B65D 2501/0027; B65D 1/42
See application file for complete search history.

(56) References Cited

U.S. PATENT DOCUMENTS

| | | | | |
|---|---|---|---|---|
| D167,637 | S | 9/1952 | Knight | |
| 3,087,491 | A | 4/1963 | Gewecke et al. | |
| 3,119,544 | A | 1/1964 | Cope et al. | |
| 3,160,326 | A | 12/1964 | Sturdevant et al. | |
| 3,176,879 | A | 4/1965 | Mojonnier | |
| 3,349,986 | A | 10/1967 | Chapman et al. | |
| 3,400,846 | A | 9/1968 | Kelly | |
| 3,499,582 | A | 3/1970 | Berney | |
| 3,927,797 | A | 12/1975 | Flider | |
| 4,033,473 | A * | 7/1977 | Raley | B65D 1/16 220/768 |
| 4,133,428 | A | 1/1979 | Gloyer | |
| D277,552 | S | 2/1985 | Kung | |
| 4,524,883 | A * | 6/1985 | Herring | B65D 77/065 206/509 |
| 4,579,260 | A | 4/1986 | Young et al. | |
| 4,781,314 | A | 11/1988 | Schoonover et al. | |
| 4,804,119 | A | 2/1989 | Goodall | |
| 4,805,793 | A | 2/1989 | Brandt et al. | |
| D305,982 | S | 2/1990 | Gillispie et al. | |
| 4,923,098 | A | 5/1990 | Schoonover et al. | |
| 4,927,042 | A | 5/1990 | Ring | |
| 4,969,922 | A | 11/1990 | Platte, Sr. | |
| 5,064,101 | A * | 11/1991 | Richter | B65D 21/0231 141/351 |
| 5,114,028 | A | 5/1992 | Ring | |
| 5,265,743 | A | 11/1993 | Frohn | |
| 5,299,710 | A | 4/1994 | Welsch et al. | |
| 5,340,000 | A | 8/1994 | Ring | |
| 5,462,169 | A | 10/1995 | Dygert et al. | |
| 5,497,899 | A | 3/1996 | Wuerfel | |
| 5,660,301 | A | 8/1997 | Kaplowitz | |
| D383,851 | S | 9/1997 | Wong | |
| 5,765,711 | A | 6/1998 | Johnson et al. | |
| 5,779,051 | A | 7/1998 | Boutin | |
| D397,036 | S | 8/1998 | Katakouzinos | |
| 5,908,136 | A | 6/1999 | Mrak | |
| 6,029,858 | A | 2/2000 | Srokose et al. | |
| D421,393 | S | 3/2000 | Pavely et al. | |
| 6,045,036 | A | 4/2000 | Ring | |
| 6,068,161 | A | 5/2000 | Soehnlen et al. | |
| 6,209,756 | B1 | 4/2001 | Van Der Heijden | |
| 6,237,792 | B1 | 5/2001 | Skolnicki et al. | |
| D454,789 | S | 3/2002 | Harvey et al. | |
| 6,527,133 | B1 | 3/2003 | McCollum et al. | |
| 6,588,612 | B1 | 7/2003 | Dorn et al. | |
| D488,067 | S | 4/2004 | Dorn et al. | |
| 6,763,973 | B1 | 7/2004 | Hudkins | |
| 6,889,858 | B2 | 5/2005 | McCollum et al. | |
| 6,926,163 | B2 | 8/2005 | Darr et al. | |
| 6,994,233 | B2 | 2/2006 | Dygert et al. | |
| 7,000,794 | B2 | 2/2006 | Soehnlen et al. | |
| 7,086,548 | B2 * | 8/2006 | Bartlett | B65D 25/2894 220/745 |
| 7,090,115 | B2 | 8/2006 | Pierce | |
| D554,230 | S | 10/2007 | Fletcher et al. | |
| D567,101 | S | 4/2008 | Pierre | |
| D582,783 | S | 12/2008 | Little et al. | |
| 7,681,783 | B2 | 3/2010 | Stephenson | |
| D613,178 | S | 4/2010 | Kuzma et al. | |
| 7,699,171 | B2 | 4/2010 | Rivera et al. | |
| 7,726,503 | B2 | 6/2010 | Dygert et al. | |
| D635,465 | S | 4/2011 | Pezzoli et al. | |
| 7,959,044 | B1 | 6/2011 | Christian et al. | |
| 8,365,939 | B2 | 2/2013 | Dygert et al. | |
| D684,865 | S | 6/2013 | Petronio | |
| D713,255 | S | 9/2014 | Perez-Cabrera | |
| D751,916 | S | 3/2016 | Dygert et al. | |
| 9,637,302 | B2 | 5/2017 | Kuhar et al. | |
| 9,809,353 | B2 * | 11/2017 | Gieske | B65D 21/0212 |
| 9,981,768 | B1 | 5/2018 | Palmer et al. | |
| 10,093,444 | B2 | 10/2018 | Ring et al. | |
| D833,282 | S | 11/2018 | Thompson et al. | |
| 10,183,779 | B2 | 1/2019 | Yourist | |
| D842,114 | S | 3/2019 | Bradley | |
| 10,252,834 | B2 | 4/2019 | Yourist | |
| 10,549,879 | B2 | 2/2020 | Palmer et al. | |
| D919,436 | S | 5/2021 | Currie et al. | |
| 11,027,886 | B2 * | 6/2021 | Malin | B65D 1/20 |
| 2003/0102339 | A1 * | 6/2003 | Walsh | B44D 3/12 222/567 |
| 2003/0132184 | A1 * | 7/2003 | Dorn | B65D 1/18 220/511 |
| 2003/0160092 | A1 | 8/2003 | Philips et al. | |
| 2006/0202004 | A1 | 9/2006 | Holt | |
| 2007/0023384 | A1 | 2/2007 | Janeczek | |
| 2008/0073317 | A1 * | 3/2008 | Dygert | B65D 77/0426 215/397 |
| 2017/0102225 | A1 | 4/2017 | Palmer et al. | |
| 2018/0370676 | A1 | 12/2018 | Thompson et al. | |

FOREIGN PATENT DOCUMENTS

| | | | |
|---|---|---|---|
| CA | 2664553 | C | 12/2014 |
| CA | 2848379 | C | 9/2019 |
| EP | 2455296 | A1 | 5/2012 |
| EP | 2069212 | B1 | 1/2013 |
| EP | 2755897 | B1 | 7/2014 |
| WO | 2008039713 | A2 | 4/2008 |
| WO | 2008039713 | A3 | 4/2008 |
| WO | 2011106698 | | 9/2011 |

OTHER PUBLICATIONS

Notice of Allowance, dated Aug. 9, 2021, from corresponding U.S. Appl. No. 17/179,621.
Office Action, dated Apr. 7, 2021, from corresponding U.S. Appl. No. 17/179,621.
Written Opinion of the International Searching Authority, dated Jun. 8, 2021, from corresponding International Application No. PCT/US2021/018673.
Restriction Requirement, dated Feb. 28, 2022, from corresponding U.S. Appl. No. 29/725,092.
Office Action, dated Sep. 14, 2022, from corresponding U.S. Appl. No. 29/725,092.

* cited by examiner

BOXED CONTAINER SYSTEM

CROSS-REFERENCE TO RELATED APPLICATION

This application is a continuation of U.S. patent application Ser. No. 17/179,621, filed Feb. 19, 2021, entitled "BOXED CONTAINER SYSTEM", which claims priority to U.S. Provisional Patent Application Ser. No. 62/979,877, filed Feb. 21, 2020, entitled, "BOXED CONTAINER SYSTEM," the disclosures of which are hereby incorporated by reference in their entirety.

BACKGROUND

Conventional containers include a container body, typically manufactured from plastic or other suitable polymer-based material, or as a carton or box made from paperboard, corrugated fiberboard, or other suitable material. Containers often have a handle and a closeable opening or spout for pouring out the contents as desired. Plastic manufacturing techniques allow for virtually any shape, size, and configuration of container that is easy to use and often targeted to a specific material to be stored or use of that container and material within. For example, large containers for holding large quantities of a fluid that are designed to be carried, lifted, and poured out often include a large handle across a top portion of the bottle and an opening positioned near an edge of the top for pouring the contents out. When manufactured in plastic, these larger containers are often thick to support and contain the quantity of liquid stored within. Thick walls increase manufacturing costs. Moreover, the handles and non-planar top portion of many containers prevent stacking. Some containers are placed in boxes, which provides structural support to the containers. However, the containers are removed from the box for use, which is cumbersome and requires additional steps to be taken.

Consequently, there is a need for improved containers that allow for the storage and subsequent pouring of relatively large quantities of fluid or material, while allowing for the containers to be stacked for storage and transportation, decreases manufacturing costs by decreasing the required plastic or polymer-based material, and allows the product within the container to be poured out without first removing a container from a box. Various embodiments of the present boxed container system recognize and address the foregoing considerations, and others, of prior art devices.

SUMMARY

It should be appreciated that this Summary is provided to introduce a selection of concepts in a simplified form that are further described below in the Detailed Description. This Summary is not intended to be used to limit the scope of the claimed subject matter.

According to one aspect of the disclosure, a container system includes a container having a container top, a container bottom, and a number of container sides. The container sides are contiguous with the container top and the container bottom. The container additionally has a number of chamfered container corners coupling adjacent sides. The chamfered container corners are contiguous with the container top and the container bottom, and each include at least one rib. The container has a handle extending from a front portion of the container top to a rear edge of the container top adjacent to a container side. A container opening is configured to access an interior of the container.

According to another aspect of the disclosure, a container system includes a container and a box. The container has a container top, a container bottom, and a number of container sides. The container sides are contiguous with the container top and the container bottom. The container additionally has a number of chamfered container corners coupling adjacent sides. The chamfered container corners are contiguous with the container top and the container bottom, and each include at least one rib. The container has a handle extending from a front portion of the container top to a rear edge of the container top adjacent to a container side while maintaining a substantially constant width. A container opening is configured to access an interior of the container. The box includes a box top, a box bottom, and a number of box sides that are contiguous with the box top and the box bottom. The box additionally has a number of chamfered box corners coupling adjacent box sides and contiguous with the box top and the box bottom. The box has a handle access aperture positioned in the box top and a spout aperture positioned in the box top. The box is sized and shaped to receive the container such that the handle is positioned within the box below the handle access aperture and the container opening is positioned within the box below the spout aperture.

According to yet another aspect of the disclosure, a container system includes a container, a box, and a spout. The container has a container top, a container bottom, and a number of container sides. The container sides are contiguous with the container top and the container bottom. The container additionally has a number of chamfered container corners coupling adjacent sides. The chamfered container corners are contiguous with the container top and the container bottom, and each include at least one rib. The container has a number of angled corners, each angled corner is configured to transition the container bottom or the container top to the chamfered container corner contiguous with the container bottom and the container top. The container also has a handle extending from a front portion of the container top to a rear edge of the container top adjacent to a container side while maintaining a substantially constant width. A container opening is configured to access an interior of the container. The box includes a box top, a box bottom, and a number of box sides that are contiguous with the box top and the box bottom. The box additionally has a number of chamfered box corners coupling adjacent box sides and contiguous with the box top and the box bottom. The box has a handle access aperture positioned in the box top and a spout aperture positioned in the box top. The box has a bottom grip aperture positioned within the box bottom. A spout is configured for removable coupling to the container opening. The spout is packaged in sealed packaging and is removably coupled to an inside surface of the box. The box is sized and shaped to receive the container such that the handle is positioned within the box below the handle access aperture and the container opening is positioned within the box below the spout aperture.

BRIEF DESCRIPTION OF THE DRAWINGS

Various embodiments of the disclosure will be described below. In the course of the description, reference will be made to the accompanying drawings, which are not necessarily drawn to scale, and wherein.

DETAILED DESCRIPTION OF VARIOUS EMBODIMENTS

Various embodiments will now be described more fully hereinafter with reference to the accompanying drawings. It should be understood that the concepts disclosed herein may be embodied in many different forms and should not be construed as limited to the embodiments set forth herein. Rather, these embodiments are provided so that this disclosure will be thorough and complete, and will fully convey the scope of the disclosure to those skilled in the art. Like numbers refer to like elements throughout.

The concepts and technologies described herein provide a plastic container that is positioned within a cardboard box. For the purposes of this disclosure, the container will be referred to as "a plastic container" or simply "a container," however it should be appreciated that any polymer-based material or other suitable material may be used without departing from the scope of this disclosure. According to one embodiment, the container described herein is manufactured from high-density polyethylene (HDPE). Similarly, the box in which the container is positioned will be described herein as being "a cardboard box" or simply "a box," however it should be appreciated that the box may be manufactured from paperboard, corrugated fiberboard, or other suitable material. The boxed container system disclosed herein is stackable, allows for decreased plastic material since the box carries a large percentage of the load and supports the container within, and provides for easy spout attachment and pouring without removing the container from the box.

Figure 1:
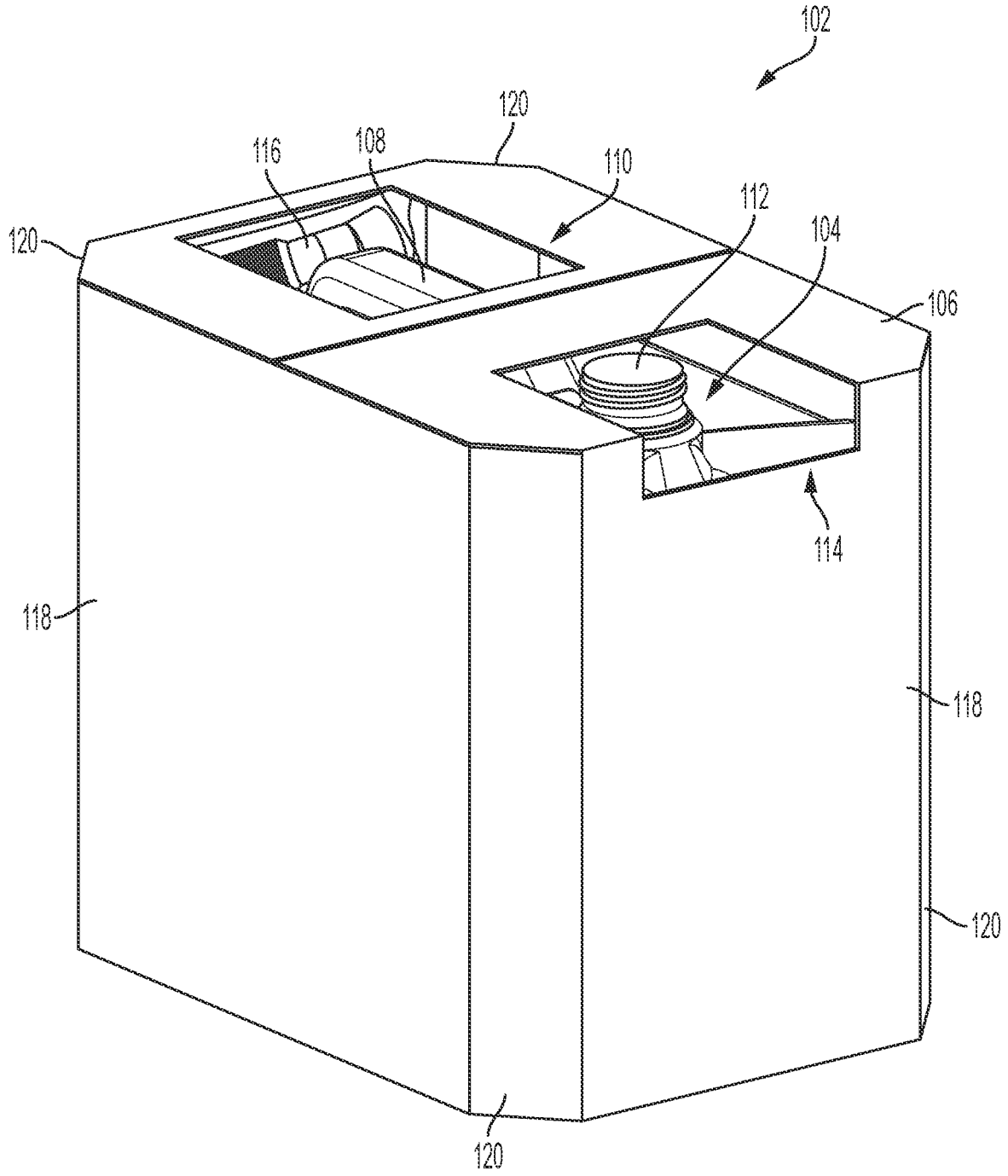
FIG. 1 is a perspective view of a boxed container system, according to various embodiments described herein.
Figure 2:
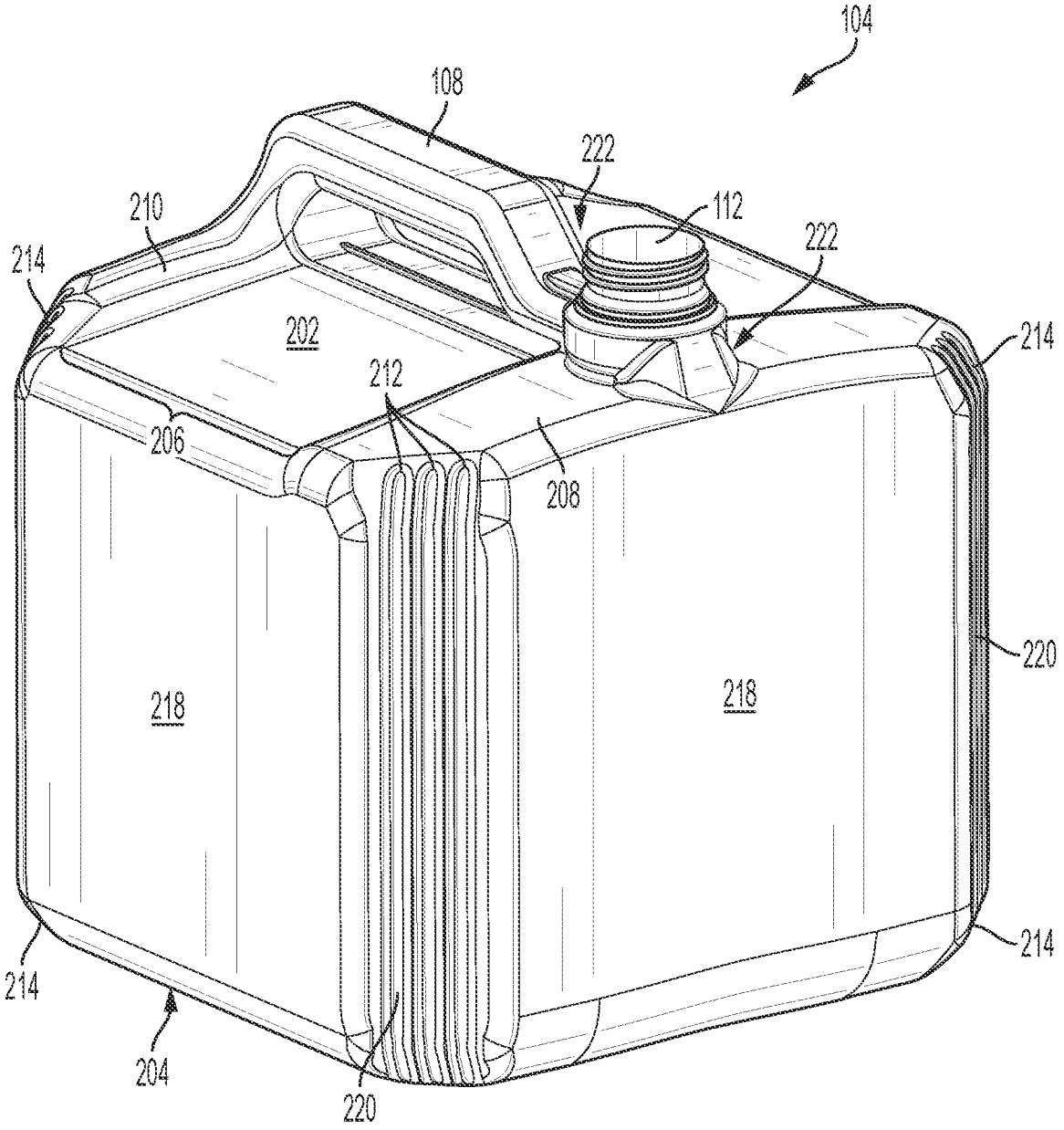
FIG. 2 is a perspective view of a container of the boxed container system, according to various embodiments described herein.

Referring now to FIG. 1, aspects of a boxed container system 102 will be discussed in detail. According to various embodiments, the boxed container system 102 includes a container 104 positioned within a box 106. The container 104 includes a handle 108 that is accessible via handle access aperture 110 in the box 106. As will be described below with respect to FIG. 9B, according to some embodiments, the handle access aperture 110 includes a spout aperture such that a top of the box 106 includes a single aperture rather than two. The handle 108 of the container 104 does not protrude from a top surface of the box 106 so as to allow for stacking of multiple boxed container systems 102 on top of one another for storage and transport. The handle access aperture 110 allows a user to grip the handle for moving the boxed container system 102 and for pouring the contents of the container 104.

A container opening 112 is positioned at a front portion of the container 104 between the handle 108 and a front wall of the container. The container opening 112 is accessible via spout aperture 114 in the box 106. The container opening 112 is sealable with a removable cap or lid and may include threads or another coupling mechanism for removably coupling a spout 116. Like the handle 108, the container opening 112 is positioned entirely within the box 106 such that no portion of the container 104 extends or protrudes from the box 106, allowing for efficient stacking and storing of multiple boxed container systems 102.

A spout 116 may be included that may be removably attached to the container opening 112 to facilitate pouring of the contents of the container 104 with minimal to no spilling. The spout 116 may be packaged within sealed packaging material to be opened by the end user in order to prevent contamination of the spout and of the material that will flow through the spout when poured prior to use. To preserve the planar configuration of all sides of the boxed container system 102, the spout 116 within the sealed packaging material may be removably secured to an inside surface of the box 106. For example, the package containing the spout 116 may be secured to an inside wall using any number of dots or strips of adhesive. It should be appreciated that the package containing the spout 116 may be attached to a side wall or to an underside of the top of the box 106. The package containing the spout 116 may be positioned at any suitable location within the box 106 that is visible to a user through the handle access and/or spout aperture and is easily accessible for the user to pull out away from the adhesive and out of the box 106 for use.

To use the spout 116, the end user accesses the spout 116 through an access aperture in the box and pulls the packaging material containing the spout off of the inside surface of the box 106. The spout 116 may then be removed from the sealed packaging material and coupled to the container opening 112 via threads or other coupling mechanism. According to alternative embodiments, the spout 116 may be loosely placed within the box 116. According to one embodiment, the box 106 has traditional 90 degree corners, while the container 104 has chamfered corners, creating a space in each corner of the box 116 into which the spout 116 may be placed. The spout 116 may be flexible and/or extendable to further facilitate pouring.

The example of the boxed container system 102 shown in FIG. 1 includes a box 106 having a box top, a box bottom, four box sides 118, and four chamfered box corners 120. The chamfered box corners 120 provide structural support for the box 106, as well as for the container 104, while providing further surfaces for marketing material. Further aspects of the box will be described below with respect to FIGS. 9A, 9B, and 10.

Turning now to FIGS. 2-8, aspects of a container 104 will be discussed. According to various embodiments, the container 104 includes a handle 108, a container opening 112, a container top 202, a container bottom 204, four container sides 218, and four chamfered container corners 220. The chamfered container corners 220 provide structural support for the container 104. To further strengthen the chamfered container corners 220, ribs 212 or reinforcements may be incorporated into the corners. The ribs 212 may be integrally formed during manufacture of the container 104 by molding the material into the desired rib configuration. Additionally or alternatively, the ribs 212 may be manufactured by utilizing additional material such that the ribs 212 are thicker than the sides 218. Although three ribs 212 are shown in the figures, it should be appreciated that any number of ribs 212 may be incorporated into the chamfered container corners 220 without departing from the scope of this disclosure. Moreover, it should be understood that the chamfered container corners 220 may be sized and shaped identically, with the same configuration and number of ribs 212, or alternatively may have varying sizes, shapes, and/or configurations.

The container 104 additionally includes angled corners 214 on each of the eight corners at the top and bottom of the four chamfered container corners 220. The angled corners 214 transition between the container bottom 204 and the container sides 218, or more specifically, between the container bottom 204 and the chamfered container corners 220. Similarly, the angled corners 214 at the top of the container 104 transition between the container top 202 and the chamfered container corners 220. The angled corners 214 provide a relatively smooth or gradual transition that provides structural benefits while additionally assisting in placement of the container 104 into the box 106 when assembling the boxed container system 102.

The container top 202 has several features, including a recessed portion 206, a raised front portion 208, and a raised rear portion 210. The configuration of the recessed portion 206 and the handle 108 provides for adequate space for a user's gloved hand when carrying or pouring from the container 104. The raised front portion 208 and the raised rear portion 210 are rigidizing features that provide structural support for the container 104 by enhancing the torsional rigidity of the container that is useful to oppose forces imposed when the container 104 is carried by the handle 108.

According to one embodiment, the handle 108 extends from a position proximate to the container opening 112 to a rear edge of the container top 202 adjacent the side 218, or in other words, to the raised rear portion 210, while maintaining a substantially constant width. The raised rear portion 210 does not serve as a grip as it abuts a back inside wall of the box 106. Rather, the raised rear portion 210 is independent from the handle 108 or grip and provides structural support with the handle 108 being the means by which the user lifts and manipulates the boxed container system 102.

Figure 5:
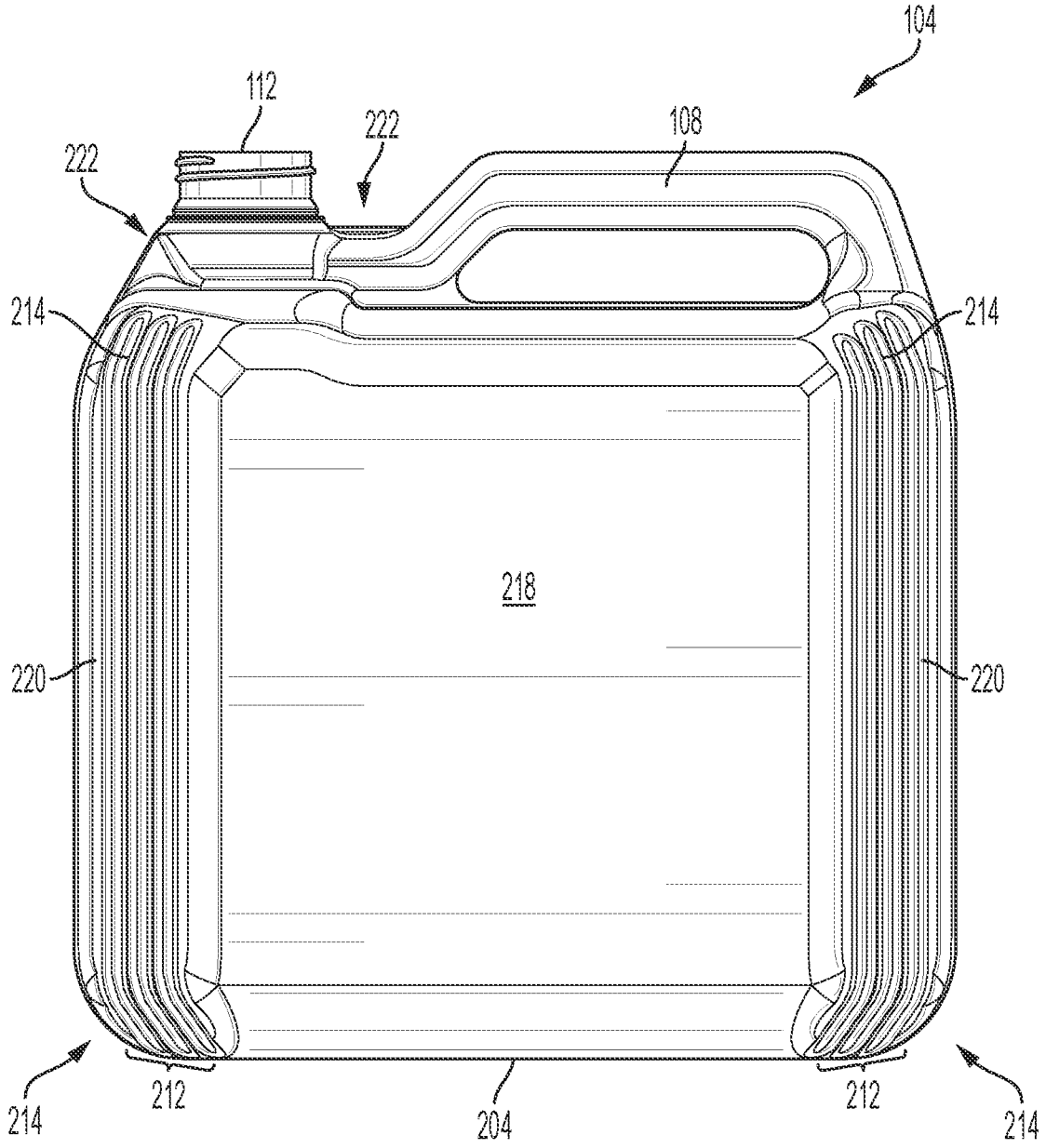
FIG. 5 is a right side elevation view of the container of the boxed container system, according to various embodiments described herein.
Figure 6:
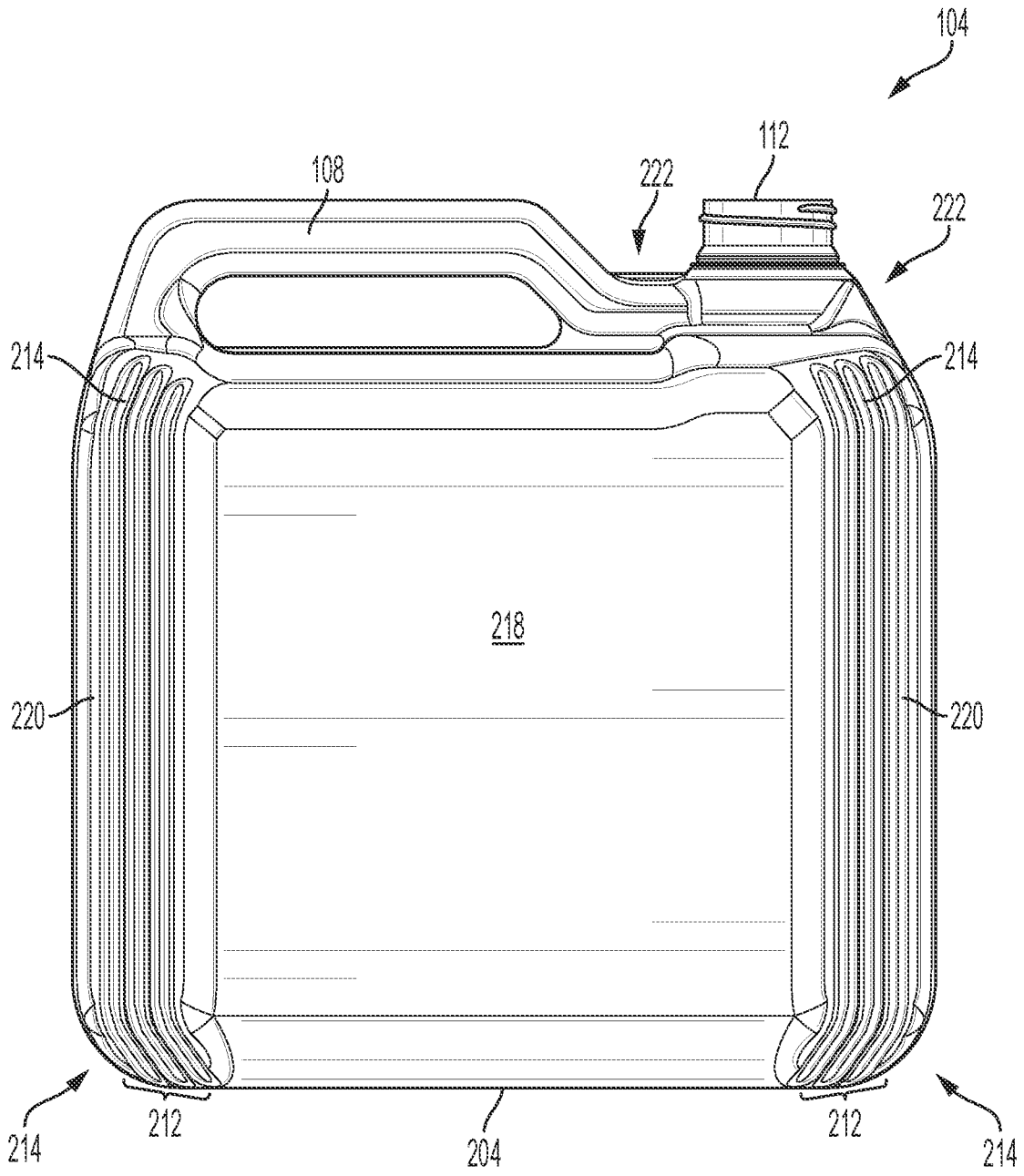
FIG. 6 is a left side elevation view of the container of the boxed container system, according to various embodiments described herein.

As best seen in FIG. 5, the handle 108 includes a hollow front portion that is proximate to and in fluid communication with the container opening 112. The hollow front portion is positioned below a top edge of the container opening 112. A hollow middle portion of the handle 108 is in fluid communication with the hollow front portion. A central axis of the hollow middle portion is substantially colinear with a center of the container opening. A top surface of the hollow middle portion is substantially level with the top edge of the container opening 112. The handle 108 has a hollow rear portion that is in fluid communication with the hollow middle portion, extending downward from the hollow middle portion to a rear wall 218 of the container 104.

Figure 3:
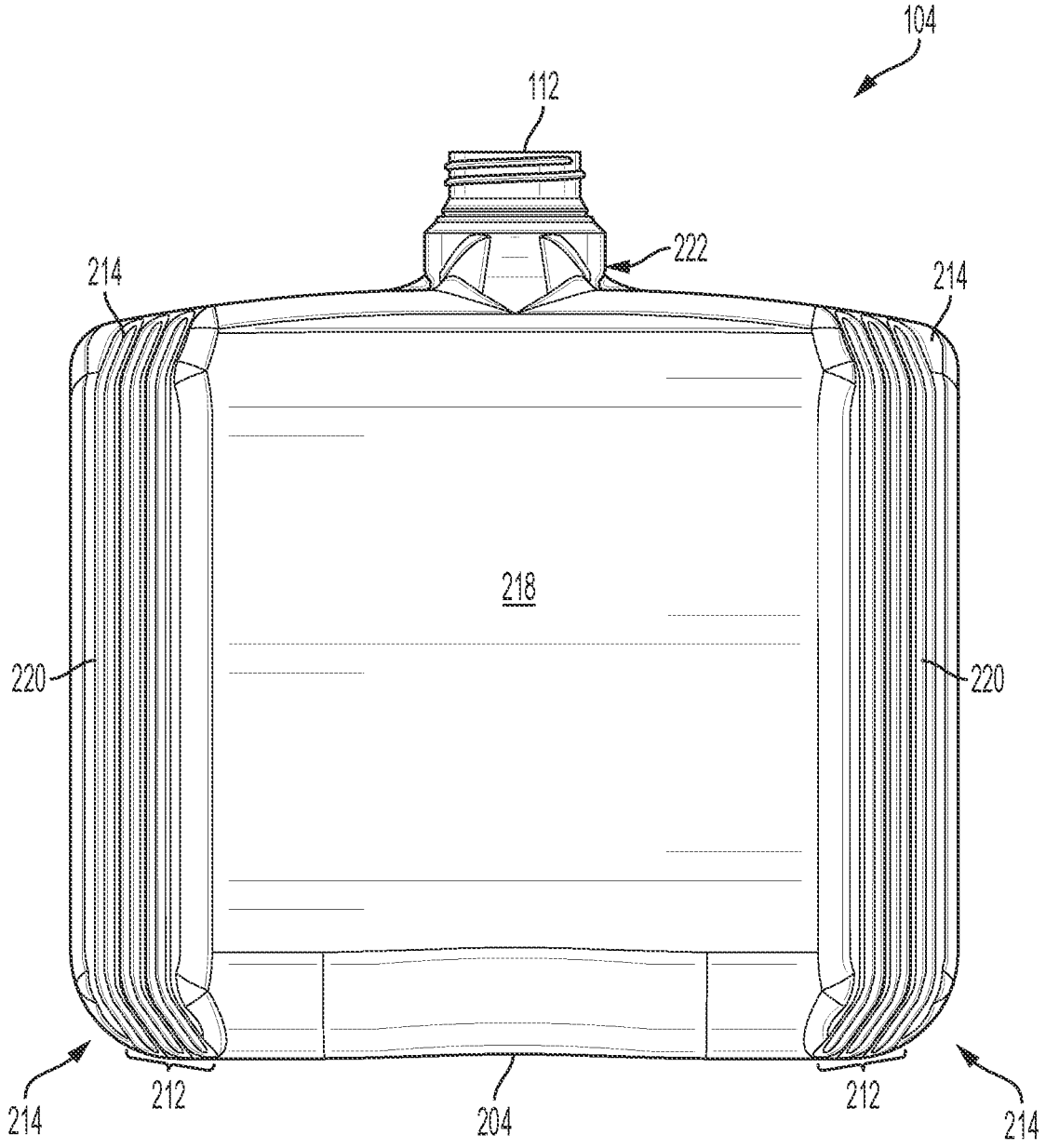
FIG. 3 is a rear elevation view of the container of the boxed container system, according to various embodiments described herein.
Figure 4:
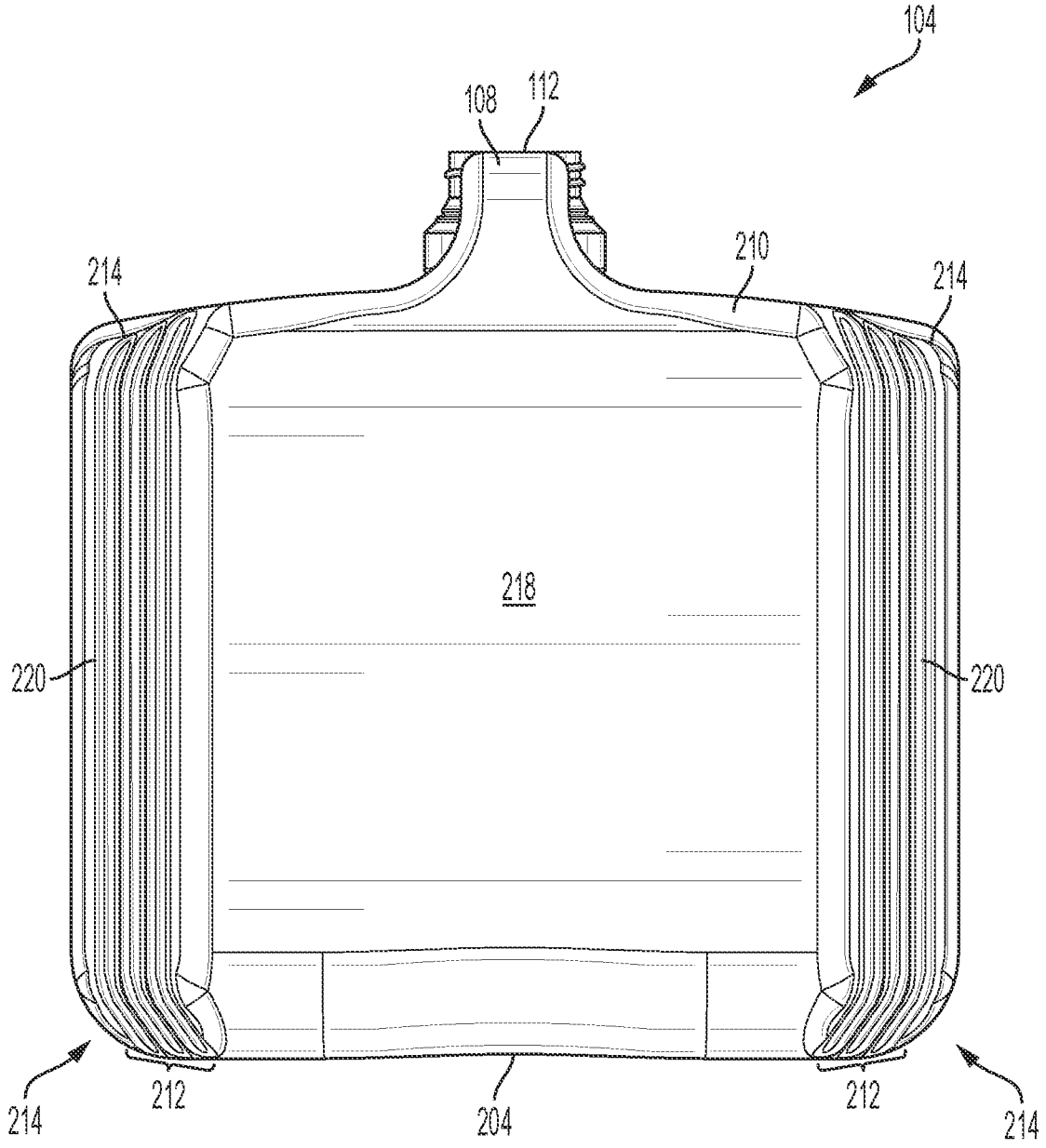
FIG. 4 is a front elevation view of the container of the boxed container system, according to various embodiments described herein.
Figure 7:
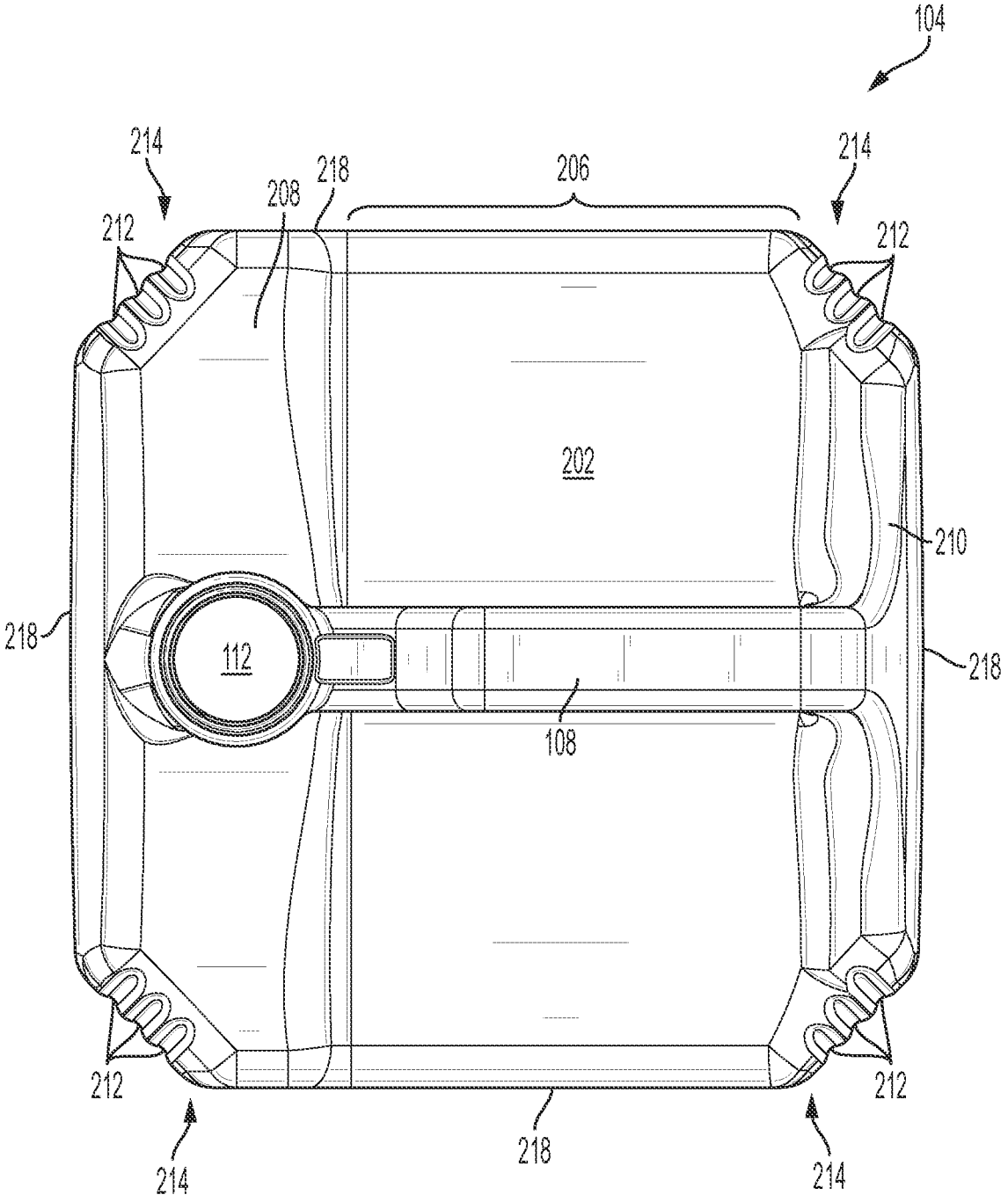
FIG. 7 is a top plan view of the container of the boxed container system, according to various embodiments described herein.
Figure 8:
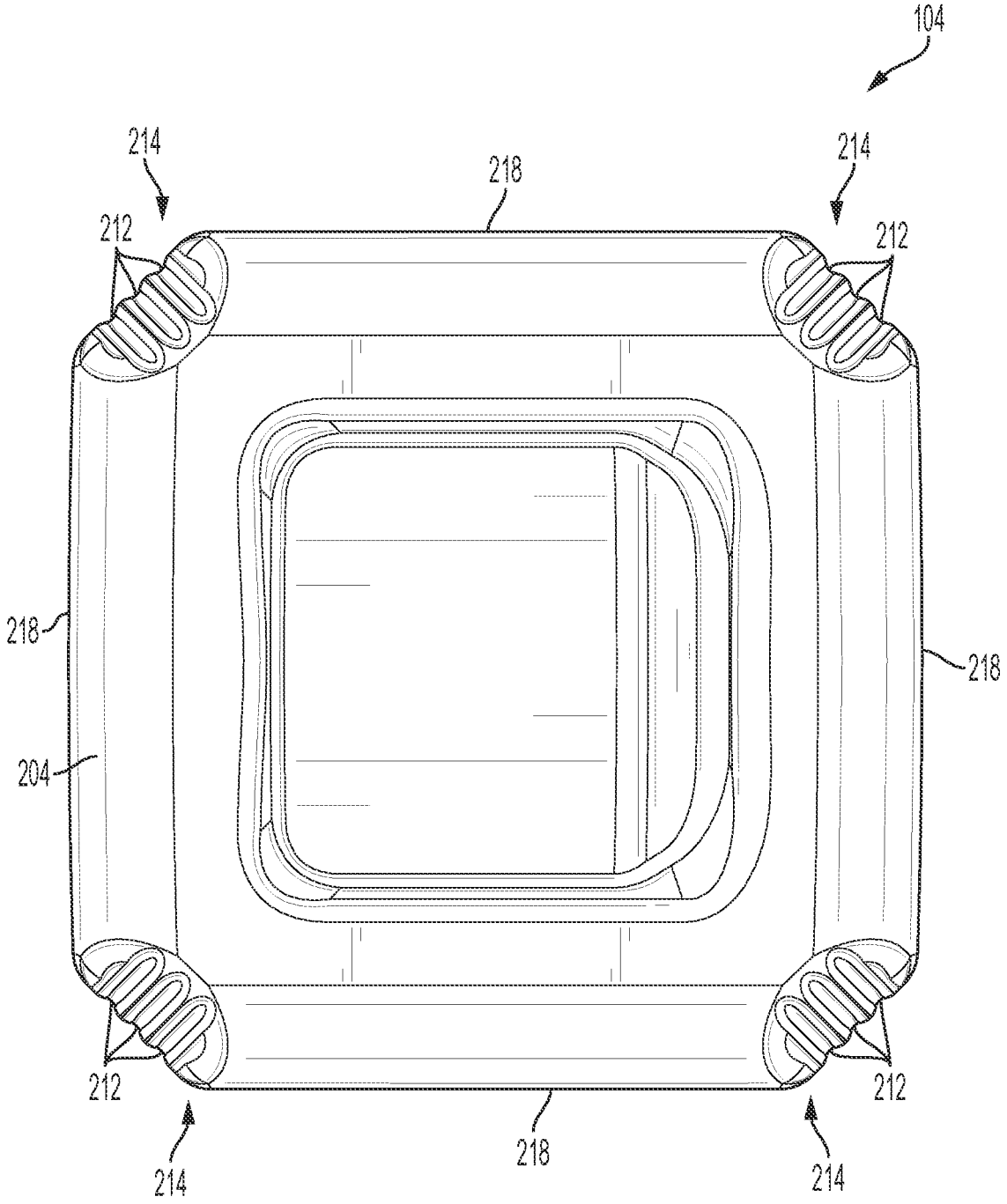
FIG. 8 is a bottom plan view of the container of the boxed container system, according to various embodiments described herein.

According to various embodiments, the container 104 includes a glug mitigation mechanism 222 that maximizes airflow through the container opening 112 and around the fluid within the container 104 as the container is tipped and the fluid is poured out. Specifically, the neck of the container 104 near the container opening 112 includes a tunnel or channel on the front side of the container 104 that routes the fluid out of the front portion of the container opening 112, while ambient air flows in the rear portion of the container opening 112 during pouring. As best seen in FIGS. 3 and 7, the tunnel or channel is positioned between a front side of the container 104 and the container opening 112.

The glug mitigation mechanism 222 further includes a unique configuration of the handle 108 that routes the air from the rear portion of the container opening 112 and through the handle 108 to the rear wall 218 and around the fluid as the container 104 is tipped forward to pour. According to one embodiment, the container 104 may be provide a substantially square footprint and a substantially cubic form factor, holding approximately 2.5 gallons of fluid within. However, it should be appreciated that the container 104 may have any dimensions and hold any quantity of fluid without departing from the scope of this disclosure.

Figure 9A:
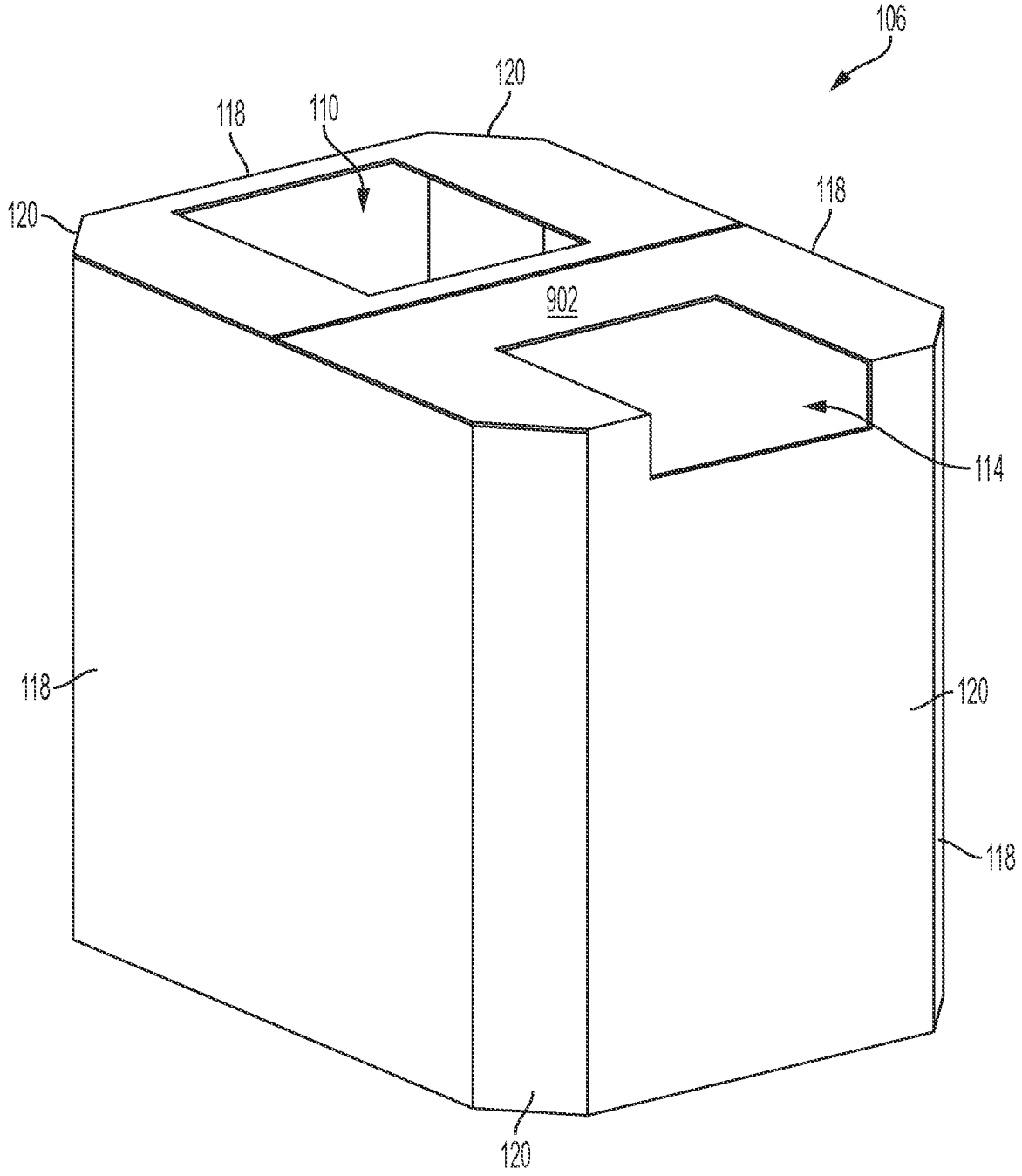
FIG. 9A is a perspective view of a box of the boxed container system having separate handle access and spout apertures, according to various embodiments described herein.

Looking now at FIGS. 9A, 9B, and 10, aspects of the box 106 will now be described. As discussed above, embodiments of the box 106 may include a box top 902, a box bottom 1002, four box sides 118, and four chamfered box corners 120. The chamfered box corners 120 provide structural support for the box 106, as well as for the container 104, while providing further surfaces for marketing material. As seen in FIG. 9A, the box 106 includes a handle access aperture 110 in a rear flap or portion of the box top 902 that is sized to allow a user to reach in the box 106 and grasp the handle 108 of the container 104, without the handle 108 protruding through the handle access aperture 110. In this manner, a user may pick up and move the boxed container system 102 for transport, storage, or to pour out the contents of the container 104.

Additionally, the box 106 includes a spout aperture 114 positioned in a front flap or portion of the box top 902 that is sized to allow a user to connect the spout 116 to the container opening 116 for pouring. Once connected, the spout 116 will extend through the box 106 to facilitate pouring. The spout aperture 114 may extend into a portion of the front side 118 of the box 106. This configuration allows greater flexibility of the spout 116 to be bent forward and downward after attachment and during pouring, which further assists the user during pouring as the container 104 does not initially have to be tilted as far if the spout 116 may flex forward and downward. It should be appreciated that the handle access aperture 110 and the spout aperture 114 may be shaped and sized as desired, including having corners with 90-degree angles as shown, or having all or any portion of the apertures being rounded off or curved.

Figure 9B:
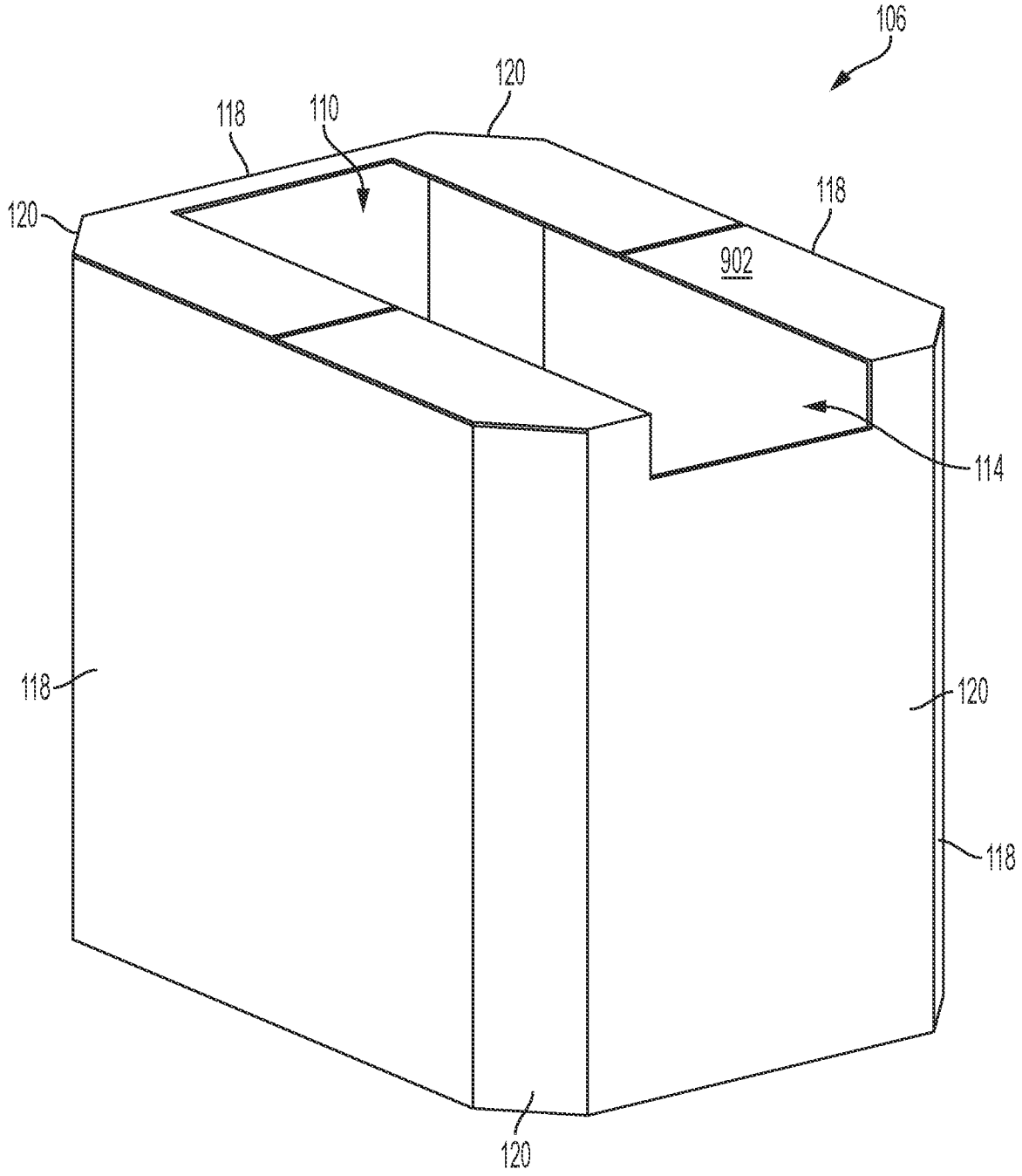
FIG. 9B is a perspective view of a box of the boxed container system having a single handle access and spout aperture, according to various embodiments described herein.
Figure 10:
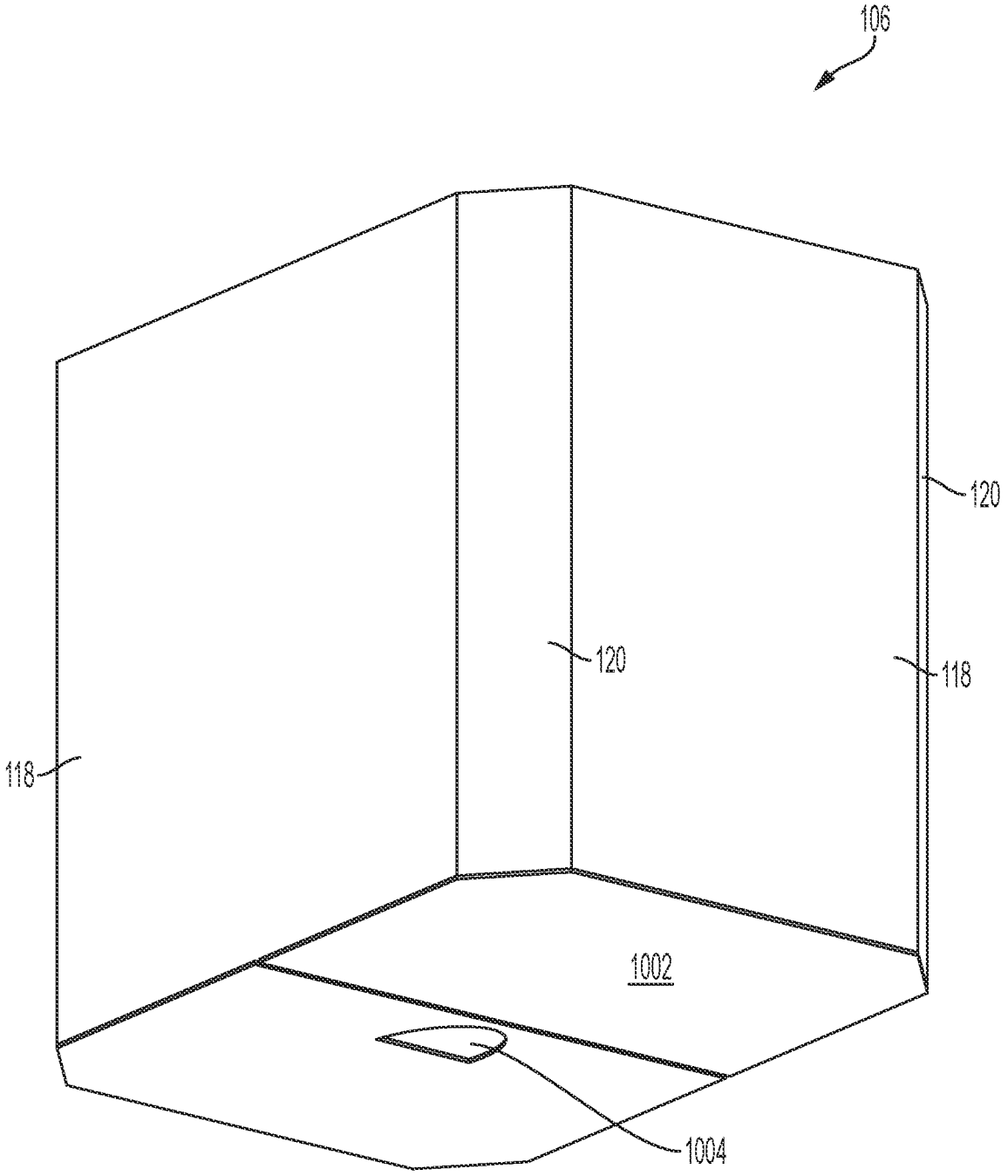
FIG. 10 is a bottom perspective view of the box of the boxed container system, according to various embodiments described herein.

According to an alternative embodiment shown in FIG. 9B, the handle access aperture 110 and the spout aperture 114 may be sized and configured as a single aperture through which the handle 108 and the container opening 112 are both accessible. In this embodiment, the box top 902 provides enough surface area and structural support to allow for the stacking of multiple boxed container systems 102 while maximizing access to the handle 108 and container opening 112 of the container 104 within.

The box 106 is shaped and sized to accommodate the container 104 without allowing for excessive movement of the container 104 within the box 106. Because the box 106 is used to bear a portion of the load within the container 104, in various embodiments, the fit should be snug and the box material type and thickness should be designed to withstand the forces from the filled container within. As seen in FIG. 10, the box bottom 1002 includes a bottom grip aperture

1004 that serves as a grip for the user to use when pouring contents from the container 104. When pouring, after attaching the spout 116 to the container opening 112, the user grips the handle 108 with one hand and the bottom grip aperture 1004 with the other. In doing so, the user has complete control over the angle of tilt of the boxed container system 102 and the corresponding pouring of the contents. According to the embodiment shown, the bottom grip aperture 1004 is half moon shaped. However, it should be appreciated that the bottom grip aperture 1004 is not limited to the shape, position, and configuration shown in FIG. 10. Rather, any size and shape of aperture may be placed in an appropriate position on the box bottom 1002 for use as a grip to assist pouring. Further, according to various embodiments, the bottom grip aperture 1004 may be reinforced with material, either box material from the aperture that is folded in or out, or additional material or structural support added to the area of the bottom grip aperture 1004 being gripped by the user.

CONCLUSION

Many modifications and other embodiments of the disclosure will come to mind to one skilled in the art to which this disclosure pertains having the benefit of the teachings presented in the foregoing descriptions and the associated drawings. For example, as will be understood by one skilled in the relevant field in light of this disclosure, the disclosure may take form in a variety of different mechanical and operational configurations. Therefore, it is to be understood that the disclosure is not to be limited to the specific embodiments disclosed herein, and that the modifications and other embodiments are intended to be included within the scope of the appended exemplary concepts. Although specific terms are employed herein, they are used in a generic and descriptive sense only and not for the purposes of limitation.

It should be understood that, although various advantages or features of particular aspects of various embodiments are described above, it should be understood that alternative embodiments of the claimed invention may or may not have one or more of the stated advantages described herein.

What is claimed:

1. A container system, comprising:

a container, comprising:

a container top;

a container bottom;

a plurality of container sides contiguous with the container top and the container bottom;

a plurality of chamfered container corners coupling adjacent container sides and contiguous with the container top and the container bottom, each chamfered container corner comprising at least one rib, wherein at least a portion of the at least one rib is centrally positioned between the container top and the container bottom;

an elongated handle disposed on the container top; and a container opening configured to provide access to an interior of the container, wherein the handle extends from a rear portion of the container top toward the container opening, and wherein:

the at least one rib comprises a plurality of ribs;

each of the plurality of ribs is in the shape of an elongated oval; and a width of each of the plurality of ribs is greater than about 20% of the width of the respective chamfered container corner that comprises the at least one rib.

2. The container system of claim 1, wherein the handle maintains a substantially constant width.

3. The container system of claim 1, wherein the container further comprises a glug mitigation mechanism configured to facilitate air entry into the container while pouring contents from the container opening.

4. A container comprising:

a container top;

a container bottom;

a plurality of container sides contiguous with the container top and the container bottom;

a plurality of chamfered container corners coupling adjacent container sides and contiguous with the container top and the container bottom, each chamfered container corner comprising at least one rib;

an elongated handle disposed on the container top; and a container opening configured to provide access to an interior of the container, wherein the handle extends from a rear portion of the container top toward the container opening, and wherein the glug mitigation mechanism comprises:

a tunnel or channel between a front side of the container and the container opening configured to route fluid within the container out a front portion of the container opening while air enters a rear portion of the container opening during pouring; and a handle configuration that routes the air from a rear portion of the container opening and through the handle to a rear wall of the container as the container is rotated for pouring the fluid from an interior of the container through the container opening and wherein:

the at least one rib comprises a plurality of ribs;

each of the plurality of ribs is in the shape of an elongated oval; and a width of each of the plurality of ribs is greater than about 20% of the width of the respective chamfered container corner that comprises the at least one rib.

5. A container comprising:

a container top;

a container bottom;

a plurality of container sides contiguous with the container top and the container bottom;

a plurality of chamfered container corners coupling adjacent container sides and contiguous with the container top and the container bottom, each chamfered container corner comprising at least one rib;

an elongated handle disposed on the container top; and a container opening configured to provide access to an interior of the container, wherein the handle extends from a rear portion of the container top toward the container opening, and wherein the handle comprises:

a hollow front portion proximate to and in fluid communication with the container opening, the hollow front portion positioned below a top edge of the container opening;

a hollow middle portion in fluid communication with the hollow front portion, the hollow middle portion having a central axis substantially colinear with a center of the container opening and having a top surface that is substantially level with the top edge of the container opening; and a hollow rear portion in fluid communication with the hollow middle portion, the hollow rear portion extending downward from the hollow middle portion to a rear wall of the container.

6. The container system of claim 1, wherein each of the plurality of chamfered container corners comprises at least three ribs.

7. A container system comprising:

a container comprising:

a container top;

a container bottom;

a plurality of container sides contiguous with the container top and the container bottom;

a plurality of chamfered container corners coupling adjacent container sides and contiguous with the container top and the container bottom, each chamfered container corner comprising at least one rib;

an elongated handle disposed on the container top; and a container opening configured to provide access to an interior of the container, wherein the handle extends from a rear portion of the container top toward the container opening and wherein:

the at least one rib comprises a plurality of ribs;

each of the plurality of ribs is in the shape of an elongated oval; and a width of each of the plurality of ribs is greater than about 20% of the width of the respective chamfered container corner that comprises the at least one rib, and wherein the container system further comprises:

a box, comprising:

a box top, a box bottom, a plurality of box sides contiguous with the box top and the box bottom, a plurality of chamfered box corners coupling adjacent box sides and contiguous with the box top and the box bottom, a handle access aperture positioned in the box top, and a spout aperture positioned in the box top, wherein the box is sized and shaped to receive the container such that the handle is positioned within the box below the handle access aperture and the container opening is positioned within the box below the spout aperture.

8. The container system of claim 7, further comprising a bottom grip aperture positioned within the box bottom.

9. The container system of claim 8, wherein the bottom grip aperture is half moon shaped.

10. The container system of claim 7, further comprising a spout configured for removable coupling to the container opening.

11. The container system of claim 10, wherein the spout is packaged in sealed packaging and is removably coupled to an inside surface of the box.

12. The container system of claim 7, wherein the handle access aperture and the spout aperture comprise a single aperture sized to provide access to both the handle and the container opening.

13. The container system of claim 7, wherein the handle access aperture is independent of the spout aperture.

14. The container system of claim 7, wherein the spout aperture extends into a front side of the box.

15. The container system of claim 7, wherein:

the plurality of chamfered container corners comprises four chamfered container corners; and the plurality of chamfered box corners comprises four chamfered box corners.

16. The container system of claim 15, wherein the box is shaped and sized to form a snug fit with the container so as to accommodate the container without allowing for excessive movement of the container within the box.

17. A container system, comprising:

a container, comprising:

a container top, a container bottom, a plurality of container sides contiguous with the container top and the container bottom, a plurality of chamfered container corners coupling adjacent container sides and contiguous with the container top and the container bottom, each chamfered container corner comprising at least one rib, a container opening configured to provide access to an interior of the container, and an elongated handle extending between the container opening and a rear portion of the container top, and wherein:

the at least one rib comprises a plurality of ribs;

each of the plurality of ribs is in the shape of an elongated oval; and a width of each of the plurality of ribs is greater than about 20% of the width of the respective chamfered container corner that comprises the at least one rib; and a box, comprising:

a box top, a box bottom, a plurality of box sides contiguous with the box top and the box bottom, a plurality of chamfered box corners coupling adjacent box sides and contiguous with the box top and the box bottom, a handle access aperture positioned in the box top, and a spout aperture positioned in the box top, wherein the box is sized and shaped to receive the container such that the handle is positioned within the box below the handle access aperture and the container opening is positioned within the box below the spout aperture.

18. The container system of claim 17, further comprising a bottom grip aperture positioned within the box bottom.

19. The container system of claim 17, further comprising a spout configured for removable coupling to the container opening.

20. The container system of claim 19, wherein the spout is packaged in sealed packaging and is removably coupled to an inside surface of the box.

21. The container system of claim 17, wherein the plurality of chamfered container corners comprises four chamfered container corners.

22. The container system of claim 21, wherein each of the plurality of chamfered container corners comprises a plurality of ribs.

23. The container system of claim 17, wherein the container further comprises a plurality of angled corners, each angled corner configured to transition the container bottom or the container top to the chamfered container corner contiguous with the container bottom and the container top.

24. A container system, comprising:

a container, comprising:

a container top, a container bottom, a plurality of container sides contiguous with the container top and the container bottom, a plurality of chamfered container corners coupling adjacent container sides and contiguous with the container top and the container bottom, each chamfered container corner comprising at least one rib, a plurality of angled corners, each angled corner configured to transition the container bottom or the container top to the chamfered container corner contiguous with the container bottom and the container top, a container opening configured to provide access to an interior of the container, and a handle extending between the container opening and a rear portion of the container top, and wherein:

the at least one rib comprises a plurality of ribs;

each of the plurality of ribs is in the shape of an elongated oval; and a width of each of the plurality of ribs is greater than about 20% of the width of the respective chamfered container corner that comprises the at least one rib, and a box comprising:

a box top, a box bottom, a plurality of box sides contiguous with the box top and the box bottom, a plurality of chamfered box corners coupling adjacent box sides and contiguous with the box top and the box bottom, an access aperture positioned in the box top, and a bottom grip aperture positioned within the box bottom; and a spout configured for removable coupling to the container opening, wherein the box is sized and shaped to receive the container such that the container handle and container opening are positioned within the box below the access aperture.

25. The container system of claim 24, wherein the plurality of chamfered container corners comprises four chamfered corners.

26. The container system of claim 25, wherein each of the chamfered corners comprises a plurality of ribs.

27. The container system of claim 24, wherein each of the chamfered corners comprises at least three ribs.

28. The container system of claim 24, wherein the box is shaped and sized to form a snug fit with the container so as to accommodate the container without allowing for excessive movement of the container within the box.

29. The container system of claim 1, wherein the at least one rib extends between the container top and the container bottom.

30. The container system of claim 29, wherein the at least one rib comprises a plurality of parallel ribs.

31. The container system of claim 1, wherein the at least one rib is an elongated rib that extends from a first location adjacent the container top to a second position adjacent the container bottom.

32. The container system of claim 31, wherein the at least one rib comprises a plurality of parallel ribs.

* * * * *